US006044838A

United States Patent [19]

Deng

[11] Patent Number: 6,044,838

[45] Date of Patent: Apr. 4, 2000

[54] FUME EXHAUST APPARATUS FOR COOKING STOVES

[76] Inventor: David Deng, 2668 High Ridge Dr., Chino Hills, Calif. 91709

[21] Appl. No.: 09/327,341

[22] Filed: Jun. 5, 1999

[51] Int. Cl.[7] ..... F24C 15/20

[52] U.S. Cl. ..... 126/299 D; 126/299 R

[58] Field of Search ..... 126/299 R, 299 D

[56] References Cited

U.S. PATENT DOCUMENTS 4,475,534 10/1984 Moriarty ..... 126/299 D 5,042,456 8/1991 Cote ..... 126/299 D

*Primary Examiner*—Carroll Dority

[57] ABSTRACT

A fume exhaust apparatus including a hood chamber, a primary air duct, a series of air tracks adapted to direct the air around the perimeter of the hood chamber, an exhaust plenum and a plurality of blowers to draw air into the primary air duct, force air downward over an area defined by the perimeter of the hood chamber through the air tracks in order to contain fumes generated by use of a cooking appliance and to draw the fumes away from the ambient cooking area and into the exhaust plenum.

8 Claims, 4 Drawing Sheets

FUME EXHAUST APPARATUS FOR COOKING STOVES

BACKGROUND OF THE INVENTION

1. Field of the Invention

The present invention relates generally to stove top and oven range exhaust hood ventilation systems for removing airborne grease and smoke fumes from the area above cooking appliances, and more particularly, to an apparatus that utilizes a novel air-track system to be used in conjunction with existing exhaust systems for more efficient disposal of the fumes.

2. Description of the Related Art

A considerable amount of heat, air-borne grease, fumes and odor are dispersed into the air as a common result of most household or commercial range or stove-top cooking. A number of methods and apparatuses have been devised to help eliminate these troublesome by-products, including the ubiquitous hooded vent system, including in some cases a vortex liner, adapted to be mounted above a cooking appliance in a cooking area. A fan or plurality of fans, mounted within the hood chamber, force air into the vortex liner, adapted to break down heavy grease particles before the fume and odor permeated air passes through a grease filter which is communicably conjoined between the vortex liner and the exhaust duct. The movement of this air creates a negative static charge in the area immediately behind the blowers and above the cooking area, thereby drawing the fumes upward into the exhaust plenum where it is eventually forced to the exterior of the cooking environment.

There are, however, a number of shortcomings associated with conventional hood exhaust systems. For example, in spite of the negative static charge associated with the air flow into the exhaust plenum, much of the air-borne grease, fumes and odors escape into the ambient cooking environment and beyond into other areas of the enclosed structure where such by-products are not desired. In order to prevent the excessive fumes from escaping, some existing hoods are equipped with side-wall extensions that are affixed to the lateral edges of the underside of the hood, where they hang downward in a relationship that is perpendicular to the cooking plane with the intent to act as a barrier between the area directly above a cooking appliance and the ambient cooking environment. One of the problems associated with the above solution is that the extensions are only a few inches in length, and therefore only marginally decrease the amount of fumes that escape into the ambient cooking environment and beyond. Also, the longer the hood extensions, the further down they hang, and therefore obstruct the view and accessibility of counter space to one standing directly in front of the cooking appliance. Furthermore, no means for preventing fumes from escaping below the reach of the hood extensions or into the area directly in front of the cooking appliance has been addressed by this solution.

Another existing solution which attempts to address the same problem is the free-standing splatter shield, designed to rest on the adjacent countertops and act as a barrier where the hood extensions do not reach. As is the case with the hood extensions, these barriers act as an obstruction to the adjacent counter tops and accumulate a considerable amount of grease build-up that requires frequent cleaning and/or disposal.

One objective of the present invention is to provide a system wherein fumes and grease particles are more efficiently prevented from escaping into the ambient cooking environment and beyond into other areas of the enclosed structure without the use of hood extensions or free-standing splatter shields. Another objective of this invention is to provide a system for containing fumes and grease particles in such a way so as not to obstruct the view or accessibility of the adjacent counter space. A third objective of the present invention is to provide a system for containing fumes and grease particles around the entire perimeter or the cooking appliance, including both lateral edges and the frontal areas of the appliance.

SUMMARY OF THE INVENTION

The inventor herein has determined that a need exists for an improved apparatus for ventilating fumes above a cooking space inasmuch as it provides a novel means to prevent excessive grease particles and fumes from escaping into the ambient cooking environment and beyond into the enclosed structure.

In order to accomplish these and other objectives, an apparatus for ventilating fumes above a cooking space in accordance with one embodiment of the present invention includes an additional blower mechanism adapted to draw relatively fresh air from the ambient cooking environment or elsewhere into three adjustable, enclosed air-tracks that are housed within the hood chamber which are adapted to be aligned with and adjacent to the front and side perimeters of the hood chamber; a row of apertures in the bottom portion of said air tracks which direct the drawn air downward in a path defined generally by the perimeter of the hood and more specifically by the angle predetermined by the operator of the appliance, and is sufficiently aligned with the perimeter of the cooking appliance below; a fan or plurality of fans adapted to force air and fumes upward into the exhaust plenum (including in one embodiment of the present invention a vortex liner and a grease filter) before directing the remaining by-products to the exterior of the cooking environment or enclosed structure.

The present combination provides a number of advantages over conventional hooded ventilation systems. For example, the use of an additional blower mechanism to direct air through air tracks and subsequently in the general direction of the perimeter of the cooking appliance creates an "air wall" that effectively contains most of the air-borne grease particles and fumes within the area immediately above the cooking appliance until they are drawn upward into the hood and therefore eliminates the need for the above mentioned side-wall extensions.

As a result, a significant amount of air-borne grease and fumes that would have been lost to the ambient cooking environment or other areas of the enclosed structure is directed instead up and out of the exhaust plenum. Furthermore, the elimination of the side-wall extensions means that the adjacent counter space will not be blocked from view or accessibility. Additionally, since the side-wall extensions that would ordinarily require frequent cleaning due to grease build-up would no longer be there, the preferred embodiment of this invention allows for a cleaner kitchen environment that requires less time and effort to maintain cleanliness. Finally, the said adjustable air-tracks produce three "air-walls" that effectively partition the air-borne grease particles and fumes from the ambient cooking environment which extend from the air-tracks in the hood all the way down to the surface of the cooking appliance on the two sides as well as the front of the cooking appliance, and thus eliminates the need for free-standing grease splatter shields.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of the preferred embodiments of the invention will be made with reference to the accompanying drawings.

DETAILED DESCRIPTION OF THE PREFERRED EMBODIMENT

Figure 1:
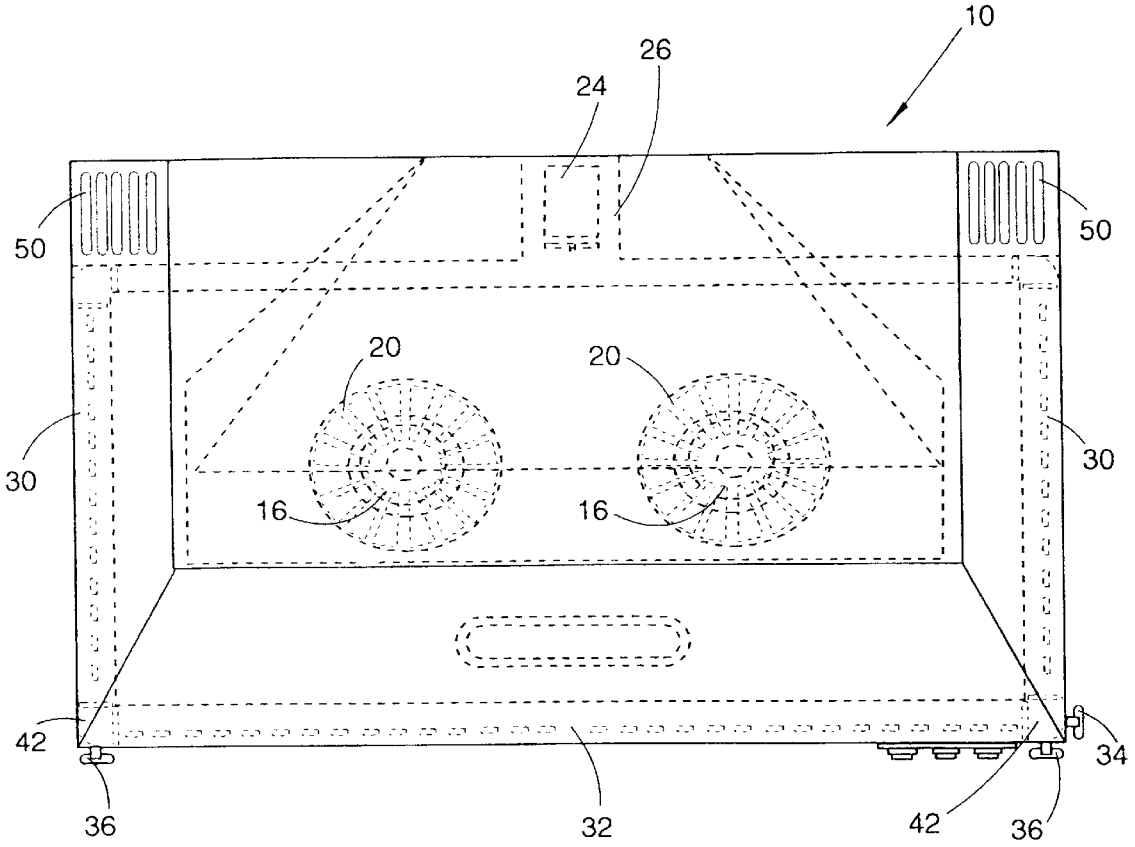
FIG. 1 is a top view of a fume exhaust apparatus in accordance with a preferred embodiment of the present invention.
Figure 2:
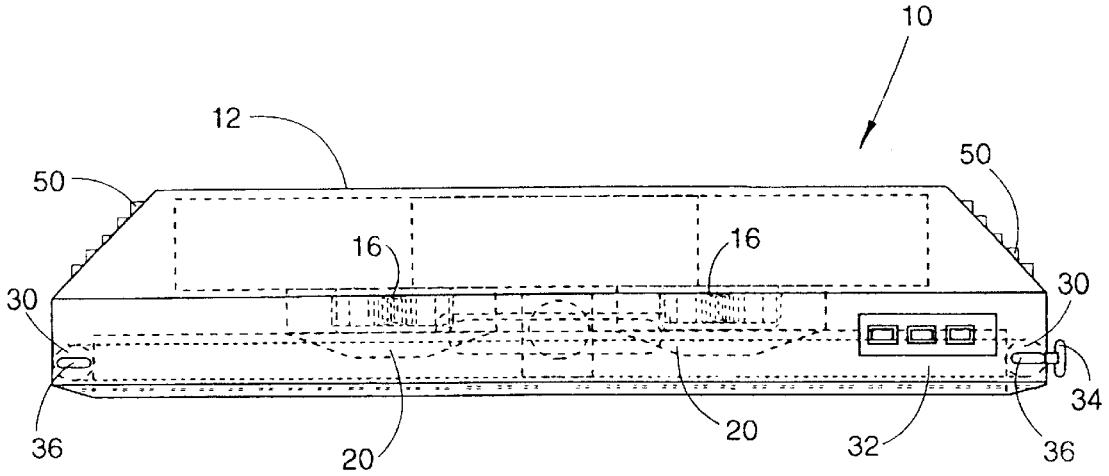
FIG. 2 is a front view of the fume exhaust apparatus depicted in FIG. 1.
Figure 3:
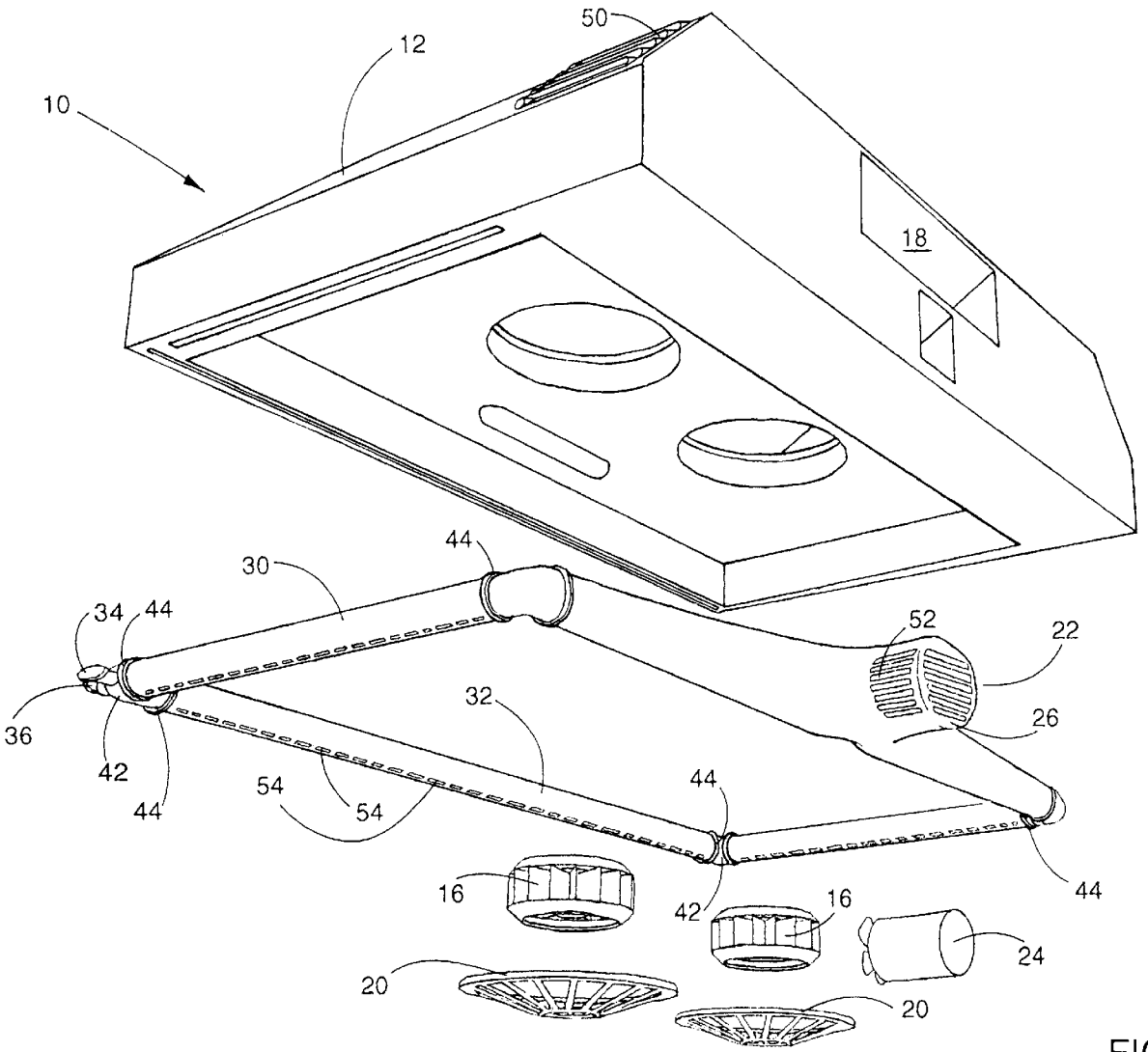
FIG. 3 is an exploded perspective view of the fume exhaust apparatus depicted in FIG. 1.
Figure 4:
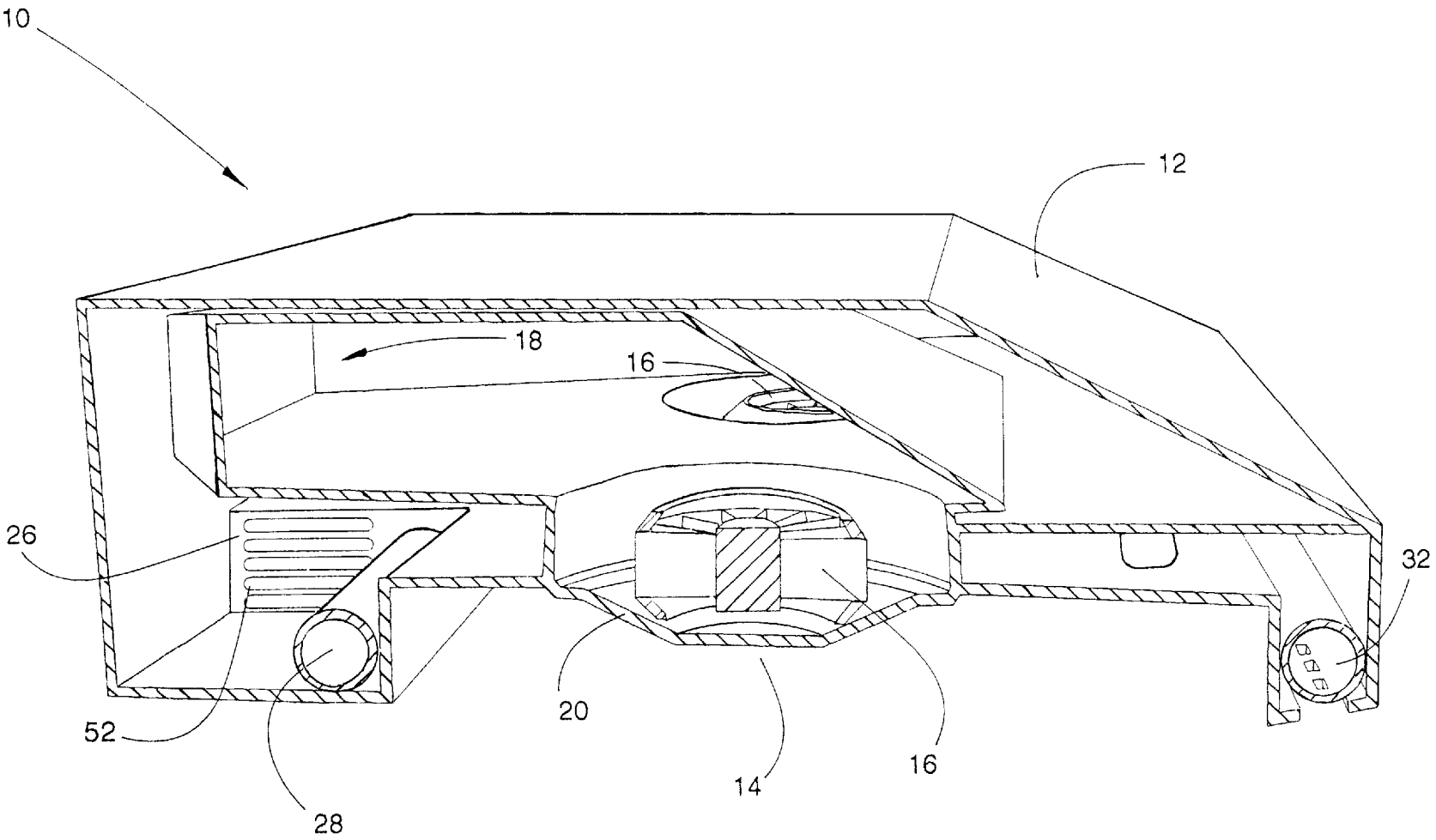
FIG. 4 is a cut-away view of the fume exhaust apparatus depicted in FIG. 1.

The following detailed description includes the best presently known modes of carrying out the invention. This description is made merely for the purpose of illustrating the general principles of the invention, and is not to be taken in a limiting sense. Furthermore, it is noted that discussion of various operating components and structural aspects of existing fume exhaust apparatus, such as the blower speed controls, vortex liner technology, grease filters, light switches, power supply and exterior ducting, which are not pertinent to the present invention, have been omitted for the sake of simplicity.

As illustrated for example in FIGS. 1, 2, 3 and 4, a fume exhaust apparatus 10 in accordance with a preferred embodiment of the present invention includes a hood 12 defining an interior chamber which includes, among other things, an exhaust assembly 14. The exhaust assembly 14 consists of a plurality of electric blowers 16 which force air through a vortex liner and filters (not shown) and into the exhaust plenum 18. This airflow creates a negative static charge in the space directly under the blowers 16, thereby creating sufficient suction to draw the grease particles and fumes in the air space above the cooking appliance upward through the exhaust intake covers 20.

In addition to the fume exhaust assembly 14, the preferred embodiment of the interior chamber of the hood also includes an air-wall facilitator 22. The air-wall facilitator 22 is comprised of an electric blower 24, a blower housing unit 26, a primary air duct 28, two lateral air tracks 30 and a frontal air track 32. The lateral openings of the primary air duct 28 are communicably conjoined to the rearward openings of the lateral air tracks 30 in such a way so as to allow for a rotation of approximately sixty degrees of the lateral air tracks 30 along the longitudinal axis of the same. Likewise, the frontal openings of the lateral air tracks 30 are communicably conjoined to the lateral openings of the frontal air track 32 in such a way so as to allow for a rotation of approximately sixty degrees of the frontal air track 32 along the longitudinal axis of the same.

Rotation of said frontal air track 32 is achieved by turning the knob 34 that extends along the longitudinal axis of said air track and protrudes through the lateral panel of the hood 12 in such a way so as to be easily accessible by one standing directly in front of the cooking apparatus. In a like manner, rotation of said lateral air tracks 30 is achieved by turning the corresponding lateral air track knobs 36 that extend along the longitudinal axis of both lateral air tracks 30 and protrude through the front panel of the hood 12.

Figure 6:
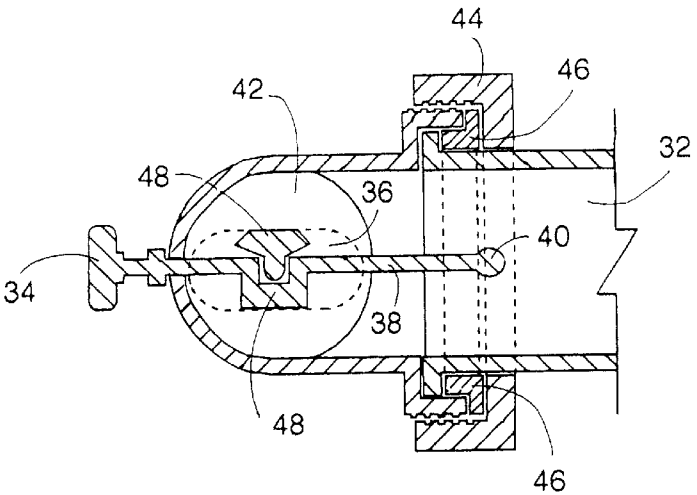
FIG. 6 is a detail front view cross section of the elbow joint and coupling of the air track depicted in FIG. 1.
Figure 5:
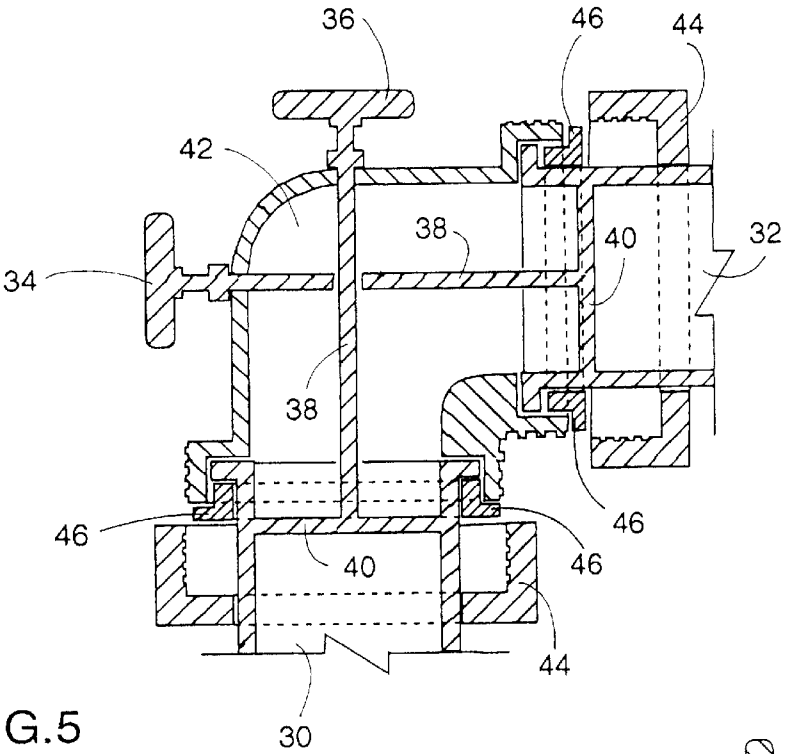
FIG. 5 is a detail top view cross section of an elbow joint and coupling of an air track depicted in FIG. 1.

As illustrated in FIG. 6 and 7, the knobs 34 and 36 of the preferred embodiment of the invention is affixed to the end of a turn shaft 38 which is in turn affixed to the center of a rod 40 that spans the interior diameter of the given air track 30 or 32. When turned, the knob 34 rotates the turn shaft 38 which in turn rotates the rod 40, and thus rotates the given air track accordingly. The air tracks 30 and 32 are communicably conjoined at their ends by way of an elbow joint 42 that utilizes threaded or otherwise interlocking couplings 44, each equipped with an o-ring seal 46 to prevent any loss of air flow at the joint. The rotation of the air track 32 is constrained to the approximated sixty degree limit by way of a protruding turn-stop 48 on the corresponding turn shaft 38 which prevents rotation beyond a given point where the turn-stop 48 meets the turn shaft 38 of the conjoining air track 32.

The blower 24, located within the blower housing unit 26, first draws air from the exterior cooking environment through a plurality of hood air inlets 50 and subsequently through a plurality of blower housing air inlets 52 of the air wall facilitator 22. The air is forced past the blower 24 and into the primary air duct 28 where it is communicated first to the lateral air tracks 30, and finally to the frontal air track 32. Upon entering the air tracks 30 and 32, the forced air is dispensed downward from the tracks located within the perimeter of the hood chamber through a row of air outlet apertures 54 in the bottom of each air track. This downward stream of forced air effectively becomes said "air-wall," which effectively contains the air-borne grease particles and fumes in the area immediately above the cooking appliance where they are in turn suctioned upward into said exhaust assembly 14.

The direction of said "air-walls" can then be adjusted by the operator of the appliance by way of the above mentioned knobs 34 and 36, allowing for differences in the density of the fumes or any other air flow through the ambient cooking environment.

Although the present invention has been described in terms of the preferred embodiment above, numerous modifications and/or additions to the above described preferred embodiments would be readily apparent to one skilled in the art. By way of example, but not limitation, said air-wall facilitator may or may not be used in conjunction with an exhaust assembly which includes a vortex liner, etc.; furthermore, all of the operating components in FIGS. 6–7 can be comprised of any number of available coupling devices. It is intended that the scope of the present invention extends to all such modifications and/or additions.

I claim:

1. A fume exhaust apparatus, comprising:

a hood chamber including a plurality of air inlets and a plurality of air outlet apertures;

a primary air duct associated with the air inlets;

a plurality of air tracks communicably conjoined with the primary air duct and adapted to direct airflow through said air outlet apertures;

a blower mechanism adapted to draw air through the air inlets and expel the air through the primary air duct, said air tracks and air outlet apertures;

a plurality of control mechanisms operably connected to said air tracks and adapted to direct the angle of rotation of said air outlet apertures whereby grease particles and fumes immediately beneath the space defined by the perimeter of said hood chamber may be contained within that space by way of the expelled air; and a fume exhaust assembly adapted to remove the grease particles and fumes from the contained space.

2. A fume exhaust apparatus as claimed in claim 1, wherein the plurality of air tracks comprises two lateral air tracks and a frontal air track.

3. A fume exhaust apparatus as claimed in claim 2 wherein the two lateral air tracks are parallel in relationship to each other and perpendicular in relationship to the frontal air track.

4. A fume exhaust apparatus as claimed in claim 3 wherein a means for connecting one end of each of the lateral air tracks to each end of the frontal air track is air-tight.

5. A fume exhaust apparatus as claimed in claim 1 wherein the plurality of control mechanisms operate independently of each other.

6. A fume exhaust apparatus as claimed in claim 5 wherein the independently operable control mechanisms are constrained to rotate within an arc radius sufficient to contain the air-borne grease particles and fumes within the space defined by the perimeter of said hood chamber.

7. A fume exhaust apparatus as claimed in claim 1 wherein the blower mechanism comprises a fan.

8. A fume exhaust apparatus as claimed in claim 1 wherein the fume exhaust assembly consists essentially of:

a blower mechanism adapted to draw air away from the space defined by the perimeter of said hood chamber and contained by the expelled air; and an exhaust plenum to expel the air-borne grease particles and fumes away from the ambient cooking environment.

* * * * *